US009363870B2

(12) United States Patent
Lim

(10) Patent No.: US 9,363,870 B2
(45) Date of Patent: Jun. 7, 2016

(54) RF SWITCH CONTROLLER POWER SUPPLY APPARATUS OF LAMP

(75) Inventor: Tae Whan Lim, Seoul (KR)

(73) Assignee: BANDI COMM TECH INC., Seoul (KR)

( * ) Notice: Subject to any disclaimer, the term of this patent is extended or adjusted under 35 U.S.C. 154(b) by 564 days.

(21) Appl. No.: 14/369,133

(22) PCT Filed: Jun. 1, 2011

(86) PCT No.: PCT/KR2011/003999

§ 371 (c)(1),
(2), (4) Date: Sep. 4, 2014

(87) PCT Pub. No.: WO2011/155722

PCT Pub. Date: Dec. 15, 2011

(65) Prior Publication Data

US 2015/0108911 A1 Apr. 23, 2015

(30) Foreign Application Priority Data

Jun. 11, 2010 (KR) ..... 10-2010-0055294

(51) Int. Cl.
*H05B 41/28* (2006.01)
*H05B 37/02* (2006.01)
*H05B 33/08* (2006.01)

(52) U.S. Cl.
CPC ..... *H05B 37/0272* (2013.01); *H05B 33/0815* (2013.01); *H05B 33/0845* (2013.01); *H05B 37/0254* (2013.01)

(58) Field of Classification Search
USPC ..... 315/312–326, 291, 247, 307, 209 R, 315/224, 225, 246
See application file for complete search history.

(56) References Cited

U.S. PATENT DOCUMENTS

| | | | | |
|---|---|---|---|---|
| 7,764,022 | B2 * | 7/2010 | Ogura et al. | 315/291 |
| 2012/0200229 | A1 * | 8/2012 | Kunst | H05B 33/0815 315/186 |
| 2013/0020955 | A1 * | 1/2013 | Igaki | H05B 33/0803 315/201 |

FOREIGN PATENT DOCUMENTS

| | | |
|---|---|---|
| JP | 2008-160787 | 7/2008 |
| KR | 10-2006-0114197 | 11/2006 |
| KR | 10-0664314 | 1/2007 |
| KR | 10-0845360 | 7/2008 |
| KR | 10-2010-0033570 | 3/2010 |

* cited by examiner

*Primary Examiner* — Tuyet Vo
(74) *Attorney, Agent, or Firm* — Weiss & Moy, P.C.; Jeffrey D. Moy

(57) ABSTRACT

The present invention relates to a radio frequency (RF) switch controller power supply apparatus. In case of the apparatus, it is possible not only to manually turn on/off electronic switches but also to remote control turning on/off a plurality of lamps installed at respective rooms by using an RF wireless remote controller. Also, since a plurality of transformers connected in series is connected to a power line toward the switches of the lamps and currents are extracted from the respective transformers, power in need is supplied to the RF switch controller.

The RF switch controller power supply apparatus includes first to third lamp switching units turning on/off first to third lamps (L1 to L3), respectively, an RF switch controller remote controlling the respective lamp switching units, and a power supply unit supplying power consumed by the RF switch controller, and the apparatus controlling turning on/off the respective lamps (L1 to L3) according to a received RF wireless remote signal, a current booster and a first rectifying unit boosting and extracting a minute current flowing through the first lamp switching unit into a high current and rectifying the current into direct current (DC) power when the respective lamp switching units are turned on, a second rectifying unit and an AC/DC converter rectifying and decompressing an alternate current (AC) supplied to a main power line and the first lamp switching unit when the first lamp switching unit is turned off, and a DC/DC converter decompressing and supplying the DC power extracted by the first rectifying unit to the RF switch controller when the lamp (L1) is turned on and compressing and supplying the DC power outputted via the AC/DC converter to the RF switch controller when the lamp (L1) is turned off.

5 Claims, 6 Drawing Sheets

RF SWITCH CONTROLLER POWER SUPPLY APPARATUS OF LAMP

RELATED APPLICATIONS

The present utility patent application is related and claims priority from PCT application no. PCT/KR2011/003999 filed Jun. 1, 2011.

BACKGROUND OF THE INVENTION

1. Field of the Invention

The present invention relates to a radio frequency (RF) switch controller power supply apparatus of a lamp, and more particularly, to an RF switch controller power supply apparatus of a lamp, in which power supplied to drive RF switches for wireless remote controlling power of indoor/outdoor lamps is extracted from alternate current power supplied to the lamps and converted into direct current power to be supplied.

2. Description of the Related Art

Turning on/off of indoor/outdoor lights installed inside/outside general are performed by directly operating mechanical switches installed being buried in walls.

That is, FIG. 1 is a circuit view illustrating general lamps and switches, in which alternate current (AC) of 220 V supplied to respective lamps L1 to L3 installed on the ceiling or a wall are turned on/off by directly operating respective switches SW1 to SW3.

In general, to solve inconvenience of directly operating switches to turn on/off lamps installed on respective rooms, bathrooms, kitchens, and outside a house, a radio frequency (RF) wireless signal is used to remote-control respective lamps and lamps installed on another room or other places are turned on/off using an RF remote-controller in one place.

FIG. 2 is a block view illustrating a wireless controller of a lamp switch buried in the wall using an RF signal according to related art, which is disclosed in Korean Patent Registration No. 10-0552072.

A user sets up an identification code of a remote controller to wireless control a lamp Lp using the remote controller and a control key to control the lamp Lp, and then the user may wireless control lamps installed respective rooms, a living room, and a bathroom.

In other words, when the user inputs an operation time of an electronic product by operating number keys provided on a key unit of the remote controller and inputs a control key corresponding to the lamp Lp, a first MPU of the remote controller transmits information on the set operation time and control key information to a control unit via a wireless transmitter.

A second MPU 42 of the control unit stores the operation time information received from the remote controller in a memory 35, operates on electronic switches 43 to 45 corresponding to the control key to turn on the corresponding lamp Lp, calculates in real time using synchronization clock generated by a clock generator 36, and automatically turn off the lamp Lp by turning off the corresponding electronic switches 43 to 45 when a value obtained by the calculation is in accordance with the set operation time stored in the memory 35.

Also, the second MPU transmits a residual operation time of the lamp Lp to the remote controller to display the residual operation time of the lamp Lp on a display unit of the remote controller in such a way that the user may know the operation time of the lamp Lp.

On the other hand, in this case, since the electronic switches 43 to 45 are connected to mechanical switches 21 to 23 installed previously in parallel to control the lamp Lp, the electronic switches 43 to 45 are remote-controlled using the remote controller to control the lamp Lp to be turned on/off while the mechanical switches 21 to 23 are turned off. When the electronic switches 43 to 45 are turned off, the lamp Lp may be freely controlled to be turned on/off using the mechanical switches 21 to 23 as general.

Also, when a control signal of the lamp Lp is inputted from the remote controller, the second MPU 42 passes over the control signal transmitted from the remote controller when load sensing units 39 to 41 connected to the lamp Lp sense loads.

Because sensing loads by the load sensing units 39 to 41 means a state in which the lamp Lp is previously turned on by the mechanical switches 21 to 23. Accordingly, the electronic switches 43 to 45 are not controlled and wireless controlling the lamp Lp using the remote controller is effective only when the mechanical switches 21 to 23 are turned off.

Also, since operating using power rectified by a transformer 46 and a bridge diode 38 and supplied via a direct current (DC) power supply 37, the second MPU 42 operates regardless of whether the lamp Lp is turned on or off. The second MPU 42 transmits present turning on/off states of the respective lamps Lp to the remote controller in such a way that the user may check the turning on/off states of the respective lamps Lp with the naked eye via the display unit 12 of the remote controller.

As described above, it may be expected that the user could conveniently control lamps installed at respective rooms and a bathroom using a remote controller.

However, in case of the conventional wireless controller for the lamp switches buried in the wall using an RF signal, electronic switches may be driven while mechanical switches for respective lamps are being turned off and it is impossible to turn on/off using the remote controller when the mechanical switches are turned on.

That is, electronic switches for remote-controlling lamps to be turned on/off are driven, and DC driving power of a circuit for receiving an RF wireless signal is extracted from AC power supplied to the lamps. For this, a transformer is connected to a power line exposed on the switches and the power is extracted.

Accordingly, in this case, when the lamps are turned off, it is possible to extract and use an enough current. However, when the lamps are turned on, a current capable of being extracted using the transformer is too weak to be used for the DC driving power to receive the wireless signal and drive electronic switches. Accordingly, to receive enough DC driving power, power should be extracted from a main AC power line. That is, it is needed to connect an exposed power line connecting the lamp to a wall switch box to a power line connected to the lamp. In this case, the main power line connected to the lamp is buried in the ceiling or a wall of a building, it is not easy to find the power line buried in the ceiling or the wall and it is very difficult to connect for extracting the AC power.

SUMMARY OF THE INVENTION

An object of the present invention is to provide a radio frequency (RF) switch controller power supply apparatus of a lamp in which an existing mechanical switch for turning on/off the lamp is removed and replaced by an electronic switch in such a way that not only the lamp is turned on/off manually using the electronic switch but also a plurality of lamps installed in respective rooms are remote controlled to be turned on/off using an RF wireless remote controller.

Another object of the present invention is to provide a method of supplying power needed for an RF switch controller by constructing a plurality of transformers in parallel on a power line of a switch side of a lamp and extracting power.

According to an aspect of the present invention, there is provided a radio frequency (RF) switch controller power supply apparatus of a lamp, the apparatus including: first to third lamp switching units turning on/off first to third lamps (L1 to L3), respectively; an RF switch controller remote controlling the respective lamp switching units; and a power supply unit supplying power consumed by the RF switch controller, and the apparatus controlling turning on/off the respective lamps (L1 to L3) according to a received RF wireless remote signal. The power supply unit includes: a current booster and a first rectifying unit boosting and extracting a minute current flowing through the first lamp switching unit into a high current and rectifying the current into direct current (DC) power when the respective lamp switching units are turned on; a second rectifying unit and an AC/DC converter rectifying and decompressing an alternate current (AC) supplied to a main power line and the first lamp switching unit when the first lamp switching unit is turned off; and a DC/DC converter decompressing and supplying the DC power extracted by the first rectifying unit to the RF switch controller when the lamp (L1) is turned on and compressing and supplying the DC power outputted via the AC/DC converter to the RF switch controller when the lamp (L1) is turned off.

The current booster may include a plurality of transformers of which first windings are connected between the main Ac power line and the first lamp switching unit in series and second windings of the respective transformers are connected in parallel, thereby boosting a current capacity by adding up minute currents extracted from the second windings of the respective transformers to be outputted to the first rectifying unit.

The RF switch controller may include an RF transceiver receiving an RF wireless switch signal from the remote controller, selection switches to allow the user to turn on/off respective lamps, a display unit for displaying states of turning on/off the respective lamps (L1 to L3), and a microcontroller unit, as switching signals for turning on/off the respective lamps (L1 to L3) are inputted from one of the RF transceiver and the selection switches, outputting one of control signals for turning on/off a corresponding one of the lamp switching units, outputting signals displaying on/off states of the respective lamps (L1 to L3) to the display unit, and transmitting present on/off states of the respective lamps (L1 to L3) to the remote controller via the RF transceiver.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, there will be described a RF switch controller power supply apparatus of a lamp according to exemplary embodiments of the present invention with reference to the attached drawings.

Figure 1:
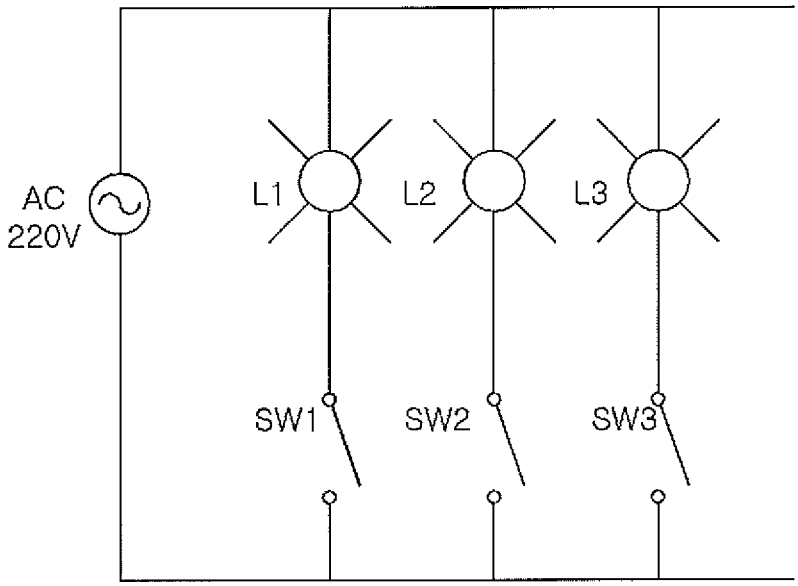
FIG. 1 is a circuit view illustrating general lamps and switches.
Figure 2:
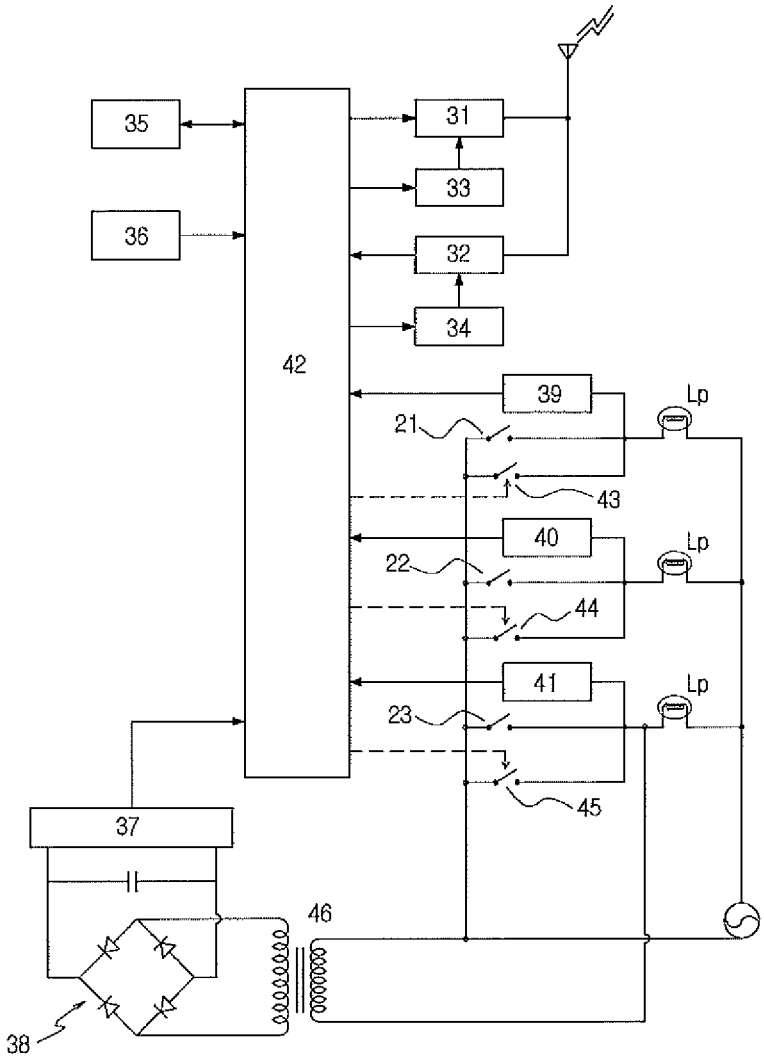
FIG. 2 is a block view illustrating a wireless controller of a lamp switch buried in the wall using a radio frequency (RF) signal according to related art.
Figure 3:
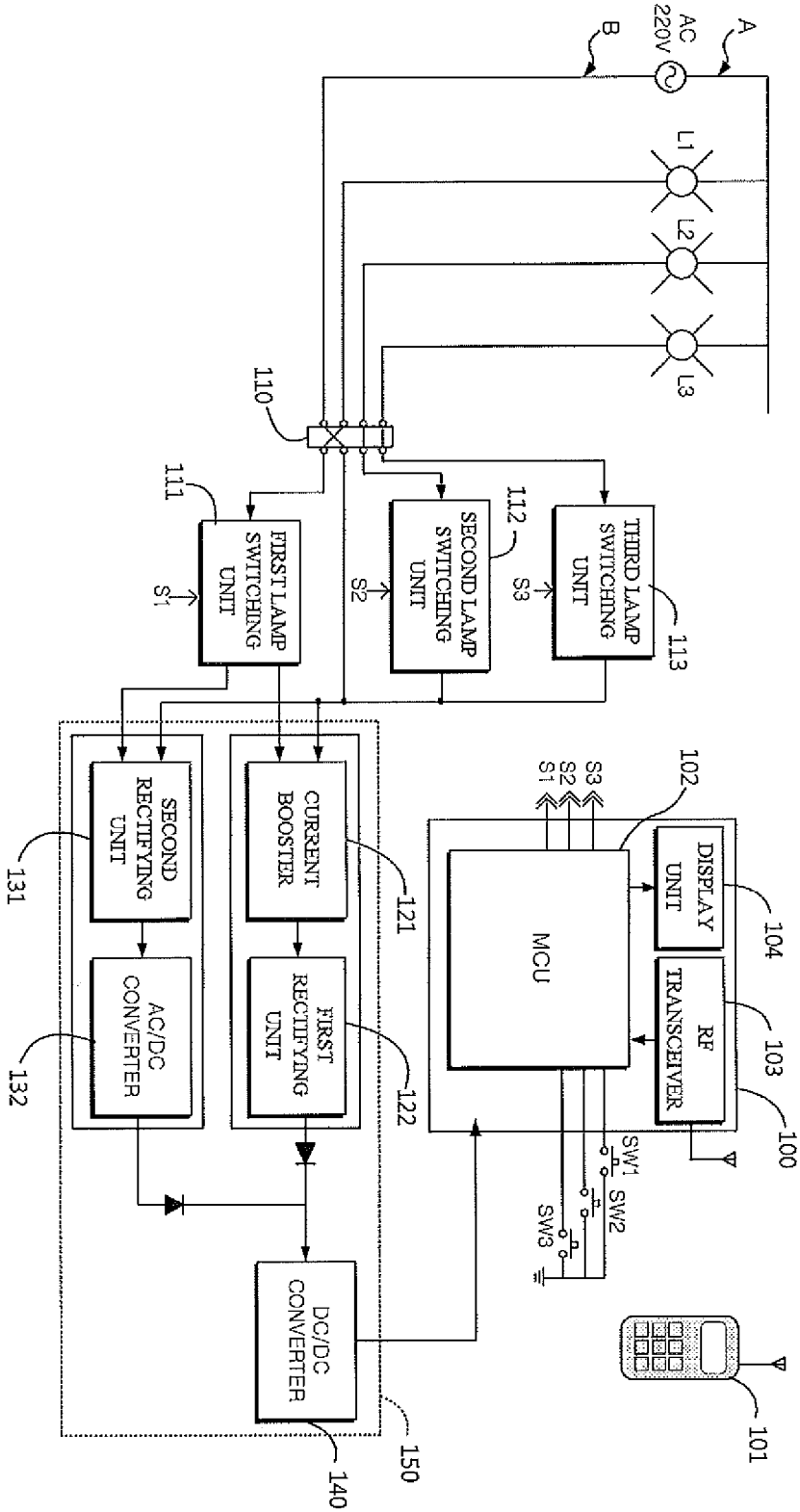
FIG. 3 is a block view illustrating an entire RF switch controller power supply apparatus of a lamp according to an embodiment of the present invention.

FIG. 3 is a block view illustrating the RF switch controller power supply apparatus of a lamp. The RF switch controller power supply apparatus of a lamp includes a plurality of lamps L1 to L3 installed inside or outside a building, first to third lamp switching units 111 to 113 for turning on/off the lamps L1 to L3, respectively, an RF switch controller 100 remote controlling the first to third lamp switching units 111 to 113 using an RF wireless signal of a remote controller 101, and a power supply unit 150 supplying power consumed by the RF switch controller 100.

The power supply unit 150 includes a current booster 121 and a first rectifying unit 122 boosting and extracting a minute current flowing through the first lamp switching unit 111 into a high current and rectifying the current into direct current (DC) power when the respective lamp switching units 111 to 113 are turned on. The power supply unit 150 also includes a second rectifying unit 131 and an AC/DC converter 132 rectifying and decompressing an alternate current (AC) supplied to a main power line and the first lamp switching unit 111 when the first lamp switching unit 111 is turned off. The power supply unit 150 also includes a DC/DC converter 140 decompressing and supplying the DC power extracted by the first rectifying unit 122 to the RF switch controller 100 when the lamp L1 is turned on and compressing and supplying the DC power outputted via the AC/DC converter 132 to the RF switch controller 100 when the lamp L1 is turned off.

The RF switch controller 100 includes an RF transceiver 103 receiving an RF wireless switch signal from the remote controller 101, selection switches SW1 to SW3 to allow the user to turn on/off respective lamps, a display unit 104 for displaying states of turning on/off the respective lamps L1 to L3, and a microcontroller unit (MCU) 102, as switching signals for turning on/off the respective lamps L1 to L3 are inputted from one of the RF transceiver 103 and the selection switches SW1 to SW3, outputting one of control signals S1 to S3 for turning on/off a corresponding one of the lamp switching units 111 to 113 and controlling the display unit 104.

Figure 4:
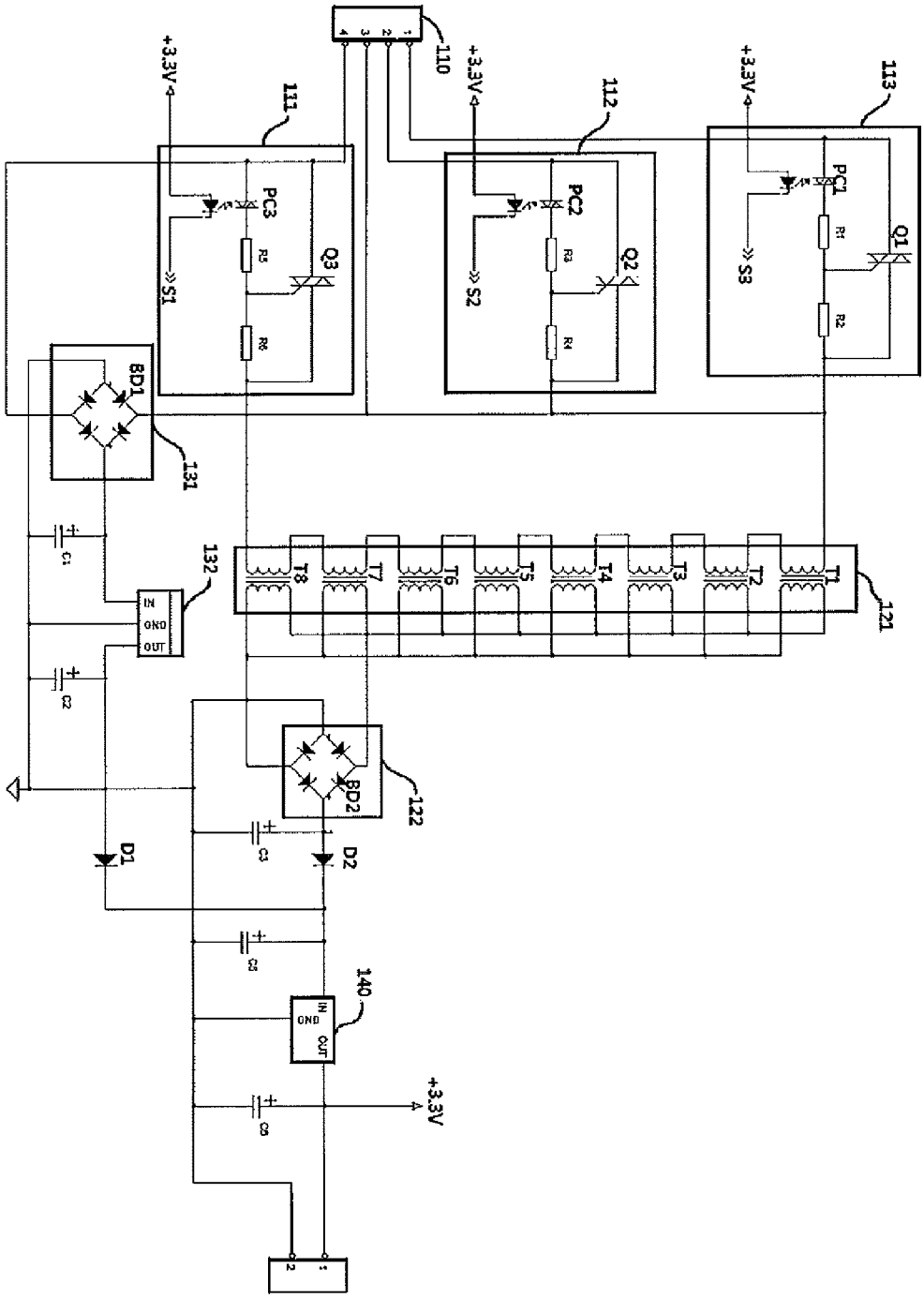
FIG. 4 is a circuit view illustrating the RF switch controller power supply apparatus of a lamp.

FIG. 4 is a detailed circuit configuration view illustrating the RF switch controller power supply apparatus of a lamp. The first to third lamp switching units 111 to 113 includes photoMOS relays PC1 to PC3 generating switch driving signals according to inputting the control signals S1 to S3 for turning on/off the respective lamps outputted from the MCU 102, and triode AC switches (TRIACs) Q1 to Q3 controlling power supply of a corresponding one of the lamps L1 to L3 according to turning on/off the photoMOS relays PC1 to PC3.

The current booster 121 is formed of a plurality of transformers T1 to T8 of which first windings are connected between the main Ac power line and the first lamp switching unit 111 in series and second windings of the respective transformers T1 to T8 are connected in parallel, thereby boosting a current capacity by adding up minute currents extracted from the second windings of the respective transformers T1 to T8 to be outputted to the first rectifying unit 122.

There will be described detailed operations of the RF switch controller power supply apparatus of a lamp with reference to FIGS. 3 to 5B as follows.

The respective lamps L1 to L3 installed on the wall or a ceiling are connected to a main power line A and receive AC power therefrom, the main power line A being buried in the ceiling of a building, and a power line toward switches of the respective lamps L1 to L3 and a main power line B toward the switches from the respective lamps L1 to L3 to a switch box are also buried in the wall.

That is, in the switch box, switches for turning on/off the respective lamps L1 to L3 are buried in one side of the wall while being in the shape of an open box, a switch terminal 110 for switching the respective lamps L1 to L3 and the main power line B is exposed inside the switch box, and the respective lamp switching units 111 to 113, the RF switch controller 100, and the power supply unit 150 are installed.

In other words, one sides of the first to third lamp switching units 111 to 113 are connected to the corresponding lamps L1 to L3 via the switching terminal 110 and other sides thereof are connected to the main power line B, thereby forming a closed loop to supply power to the corresponding lamps L1 to L3 according to turning on the corresponding lamp switching units 111 to 113.

There will be described a process of supplying power to the RF switching controller 100 in which a power connection closed loop A1 is formed when the first lamp switching unit 111 is turned on.

Figure 5:
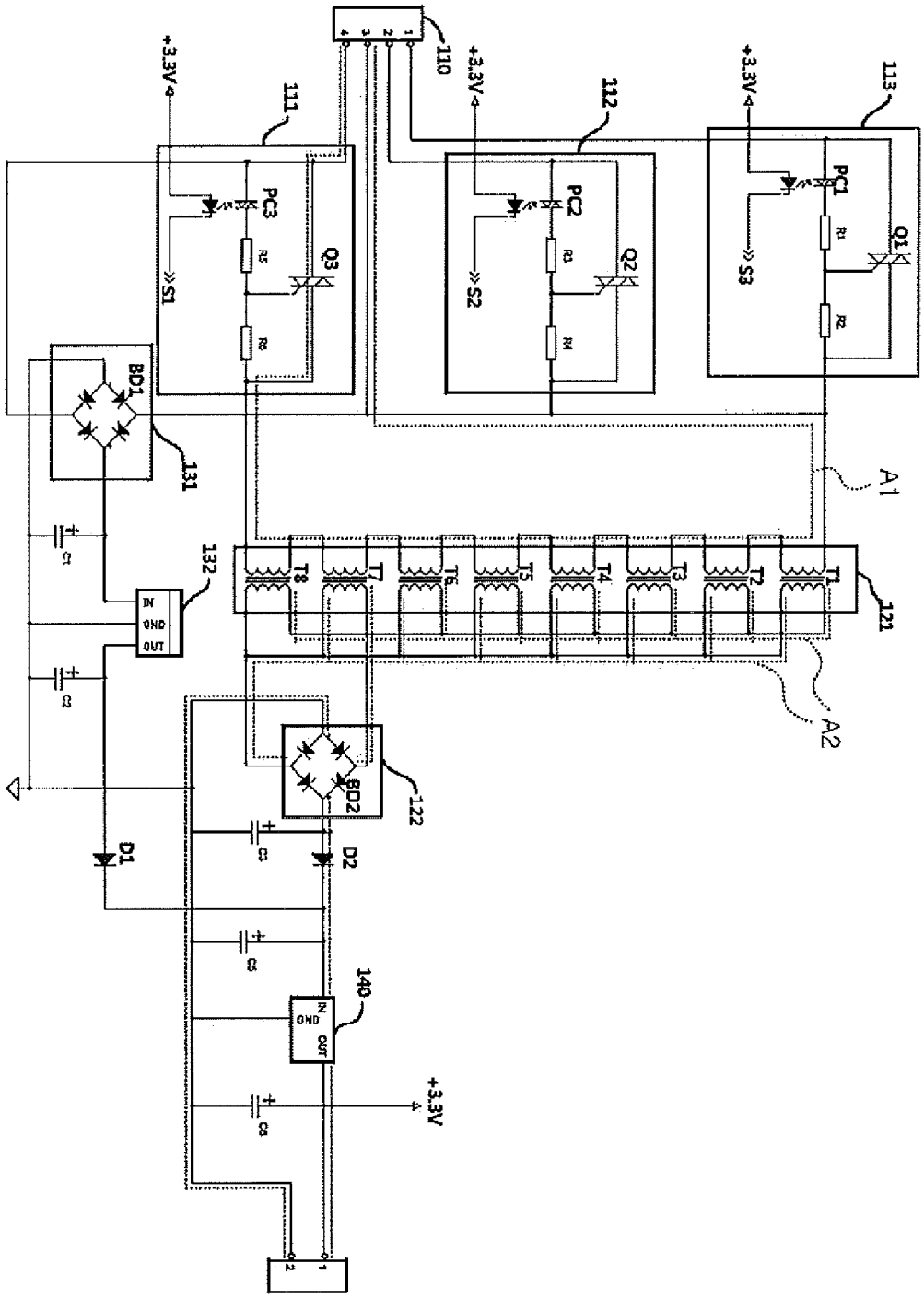
FIGS. 5 and 6 are views illustrating a connection of power when a lamp is turned on/off and supplying power to the RF switch controller.

FIG. 5 illustrates power connection and the process of supplying power to the RF switching controller 100 when a lamp is turned on. The TRIAC Q3 of the first lamp switching unit 111 is turned on and the power connection closed loop A1 is formed in such a way that minute currents are extracted from the respective second windings of the respective transformers T1 to T8 to which the first windings of the current booster 121 are connected in series.

The minute currents extracted from the second windings of the eight transformers T1 to T8 are added up as one current according to a power loop A2, thereby boosting current capacity thereof into eight times thereof and outputting the same to the first rectifying unit 122.

That is, AC power supplied being boosted by the first rectifying unit 122 is converted into a DC and outputted and converted into power of DC 3.3 V to drive the RF switch controller 100 via the DC/DC converter 140.

Figure 6:
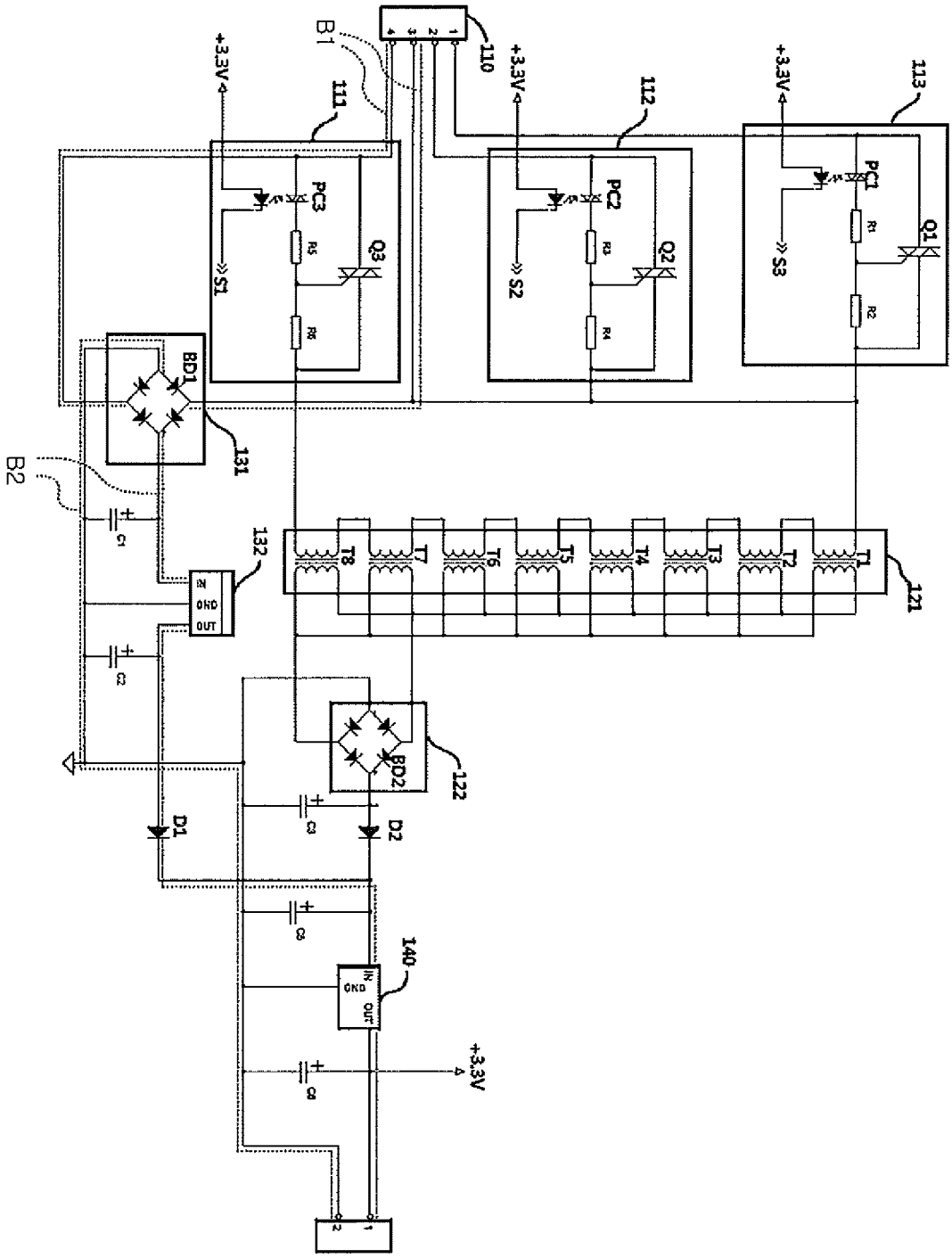

FIG. 6 illustrates power connection and supplying power to the RF switch controller 100 when a lamp is turned off. Since the TRIAC Q3 of the first lamp switching unit 111 is open, a power line connected to the first lamp L1 and power from the main power line B are connected to the second rectifying unit 131 via the switching terminal 110 and a power line B1, respectively. AC power of AC 200 V is converted into DC power, supplied to the AC/DC converter 132 via a path of B2 and converted into a DC of 5 V, and outputted to the DC/DC converter 140 via the diode D1. The DC/DC converter 140 converts the inputted DC of 5 V into a DC of 3.3 V and supplies the same to drive the RF switch controller 100.

As shown in FIGS. 5A and 5B, regardless of turning the respective lamp switching units 111 to 113 on or off in such a way that the respective lamps L1 to L3 are turned on or off, the power is converted into the DC of 3.3 V by the power supply unit 150 and supplied to the RF switch controller 100, thereby always providing power needed to drive the RF switch controller 100.

Supplying driving power thereof, the RF switch controller 100 receives a lamp remote control signal of the user from the remote controller 101 via the RF transceiver 103 and outputs the same to the MCU 102.

The MCU 102 receives a lamp control signal from the RF transceiver 103 and then outputs one of on/off signals S1 to S3 to a corresponding one of the lamp switching units 111 to 113.

As one of the on/off signals S1 to S3 turning on/off the lamps L1 to L3 is inputted, a corresponding one of the respective lamp switching units 111 to 113 turns on a corresponding one of the photoMOS relays PC1 to PC3 and the corresponding one of the TRIACs Q1 to Q3 are turned being interlocked therewith, thereby turning on a corresponding one of the lamps L1 to L3.

On the other hand, when the user directly selects and operates one of the switches SW1 to SW3 instead of using the remote controller 101, the MCU 102 senses it and allows a corresponding one of the lamps L1 to L3 to be turned on/off via the same process as the remote controlling inputted by the RF transceiver 103.

As described above, on/off states of the respective lamps L1 to L3 are displayed via the display unit 104 according to a control of the MCU 102.

Also, the MCU 102 transmits the on/off states of the respective lamps L1 to L3 to the remote controller 101 via the RF transceiver 103 and displays the on/off states of the respective lamps L1 to L3 to be checked via the remote controller 101.

As described above, the respective lamps L1 to L3 installed at a room, a bathroom, a living room, a kitchen, or an entrance may be turned on/off and the on/off states thereof may be checked by using one remote controller 101.

The RF switch controller power supply apparatus, though lamp switches for switching a plurality of lamps installed inside/outside a building are turned on, boosts a minute current flowing through an alternate current power line of a lamp switch by using a booster circuit, thereby supplying driving power for an RF switch controller.

Also, in the present embodiment, since it is possible to boost the current using the power supplied to the RF switch controller from the alternate current power line of the lamp switch, existing mechanical switches installed being buried in the wall may be replaced by electronic switches and the lamps may be turned on/off according to an RF wireless signal, in which there is no needed to find and connect an additional battery or a main alternate current line buried in the wall or the ceiling to supply power to the RF switch controller.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A radio frequency (RF) wireless switch controller power supply apparatus of a lamp, the apparatus comprising:

first to third lamp switching units (111 to 113) turning on/off first to third lamps (L1 to L3), respectively;

an RF switch controller (100) remote controlling the respective lamp switching units (111 to 113); and a power supply unit (150) supplying power consumed by the RF switch controller (100), and the apparatus controlling turning on/off the respective lamps (L1 to L3) according to a received RF wireless remote signal, wherein the power supply unit (150) comprises:

a current booster (121) coupled to the first to third lamp switching units (111 to 113), the current booster boosting current levels from the first lamp switching unit (111) when the respective lamp switching units (111 to 113) are turned on;

a first rectifying unit (122) converting the boosted current levels from the first lamp switching unit (111)

into direct current (DC) power when the respective lamp switching units (111 to 113) are turned on;

a second rectifying unit (131) coupled to the first lamp switching unit (111) rectifying an alternate current (AC) supplied to a main power line and the first lamp switching unit (111) when the first lamp switching unit (111) is turned off; and an AC/DC converter (132) converting the rectified AC current from the second rectifying unit (131) to DC power; and a DC/DC converter (140) supplying the DC power extracted by the first rectifying unit (122) to the RF switch controller (100) when the respective lamp (L1) is turned on at a desired operating voltage level and supplying the DC power outputted via the AC/DC converter (132) to the RF switch controller (100) when the respective lamp (L1) is turned off at the desired operating voltage level.

2. The apparatus of claim 1, wherein the current booster (121) comprises a plurality of transformers (T1 to T8) of which first windings are connected between the main Ac power line and the first lamp switching unit (111) in series and second windings of the respective transformers (T1 to T8) are connected in parallel, thereby boosting a current capacity by adding up minute currents extracted from the second windings of the respective transformers (T1 to T8) to be outputted to the first rectifying unit (122).

3. The apparatus of claim 1, wherein the RF switch controller (100) comprises:

an RF transceiver (103) receiving an RF wireless switch signal from the remote controller (101), selection switches (SW1 to SW3) to allow the user to turn on/off respective lamps;

a display unit (104) for displaying states of turning on/off the respective lamps (L1 to L3); and a microcontroller unit (102), as switching signals for turning on/off the respective lamps (L1 to L3) are inputted from one of the RF transceiver (103) and the selection switches (SW1 to SW3), outputting one of control signals (S1 to S3) for turning on/off a corresponding one of the lamp switching units (111 to 113), outputting signals displaying on/off states of the respective lamps (L1 to L3) to the display unit (104), and transmitting present on/off states of the respective lamps (L1 to L3) to the remote controller (101) via the RF transceiver (103).

4. The apparatus of claim 3, further comprising switches (SW1 to SW3) for directly turning on/off the lamps (L1 to L3), respectively, performed by a user, wherein user selection signals of the respective switches (SW1 to SW3) are sensed by the microcontroller unit (102) and the lamp switching units (111 to 113) are controlled to be turned on/off according to the control signals (S1 to S3).

5. The apparatus of claim 3, wherein the first to third lamp switching units (111 to 113) comprise, respectively:

photoMOS relays (PC1 to PC3) generating switch driving signals according to inputting the control signals (S1 to S3) for turning on/off the respective lamps (L1 to L3) outputted from the microcontroller unit (102), respectively; and triode AC switches (Q1 to Q3) controlling power supply of the lamps (L1 to L3) according to on/off of the photoMOS relays (PC1 to PC3), respectively.

* * * * *